US005428941A

United States Patent [19]

Staub

[11] Patent Number: 5,428,941

[45] Date of Patent: Jul. 4, 1995

[54] APPARATUS FOR WINDING A PRINTED PRODUCT AND A PROTECTIVE WRAPPING INTO A ROLL

[75] Inventor: Samuel Staub, Oberdurnten, Switzerland

[73] Assignee: Ferag AG, Hinwil, Switzerland

[21] Appl. No.: 57,537

[22] Filed: May 4, 1993

[30] Foreign Application Priority Data

May 5, 1992 [CH] Switzerland ..... 01440/92

[51] Int. Cl.[6] ..... B65B 63/04

[52] U.S. Cl. ..... 53/399; 53/118; 53/119; 53/430; 53/587; 242/528; 242/532.6; 242/541.3

[58] Field of Search ..... 53/118, 119, 211, 430, 53/587, 399; 242/528, 532.6, 541.3

[56] References Cited

U.S. PATENT DOCUMENTS

| | | | |
|---|---|---|---|
| 486,090 | 11/1892 | Crowell | 53/119 |
| 532,688 | 1/1895 | McColgan | 53/119 |
| 781,123 | 1/1905 | Boyle | 53/119 |
| 892,837 | 7/1908 | Hutchinson | 53/119 |
| 2,620,609 | 12/1952 | Pope | 53/119 |
| 2,789,406 | 4/1957 | Mosier | 53/211 X |
| 2,962,847 | 12/1960 | Thoele | 53/118 |
| 3,237,363 | 3/1966 | Spohr | 53/119 |
| 3,263,390 | 8/1966 | Dexter . | |
| 3,991,538 | 11/1976 | Finn et al. | 53/118 X |
| 4,034,928 | 7/1977 | McDonald et al. . | |
| 4,550,547 | 11/1985 | Wagner | 53/118 X |
| 4,688,366 | 8/1987 | Schmidt . | |
| 4,748,793 | 6/1988 | Brookman . | |
| 4,783,948 | 11/1988 | Kando | 53/119 |
| 4,811,548 | 3/1989 | Reist . | |
| 4,844,256 | 7/1989 | Honegger . | |
| 4,909,015 | 3/1990 | Leu . | |
| 5,101,610 | 4/1992 | Honegger . | |

FOREIGN PATENT DOCUMENTS

| | | |
|---|---|---|
| 121185 | 3/1946 | Australia . |
| 86129 | 11/1908 | Germany . |

*Primary Examiner*—John Sipos
*Assistant Examiner*—Gene L. Kim
*Attorney, Agent, or Firm*—Bell, Seltzer, Park & Gibson

[57] ABSTRACT

A belt conveyor arrangement (16) is disposed upstream of the winding mandrel (12) of the rolling-up apparatus (10) and determines the conveying path (18) for the printed products (20) which are to be rolled up. A delivery device (30) leads from below into the conveying path (18) and delivers into the conveying path (18) a wrapping (28) which is to be rolled up together with a printed product (20) in each case. The wrapping (28) has in each case an edge portion projecting over the roller (114) and by means of the blast nozzle arrangement (130) is held across the conveying path (18). This edge portion is laid around the leading end region of the printed product (20) fed and is introduced together with the latter into the mandrel gap (14). After the printed product (20) and the wrapping (28) have been rolled up, the winding mandrel (12) is moved out in the axial direction and the pressure belts (96) are brought to rest, so that the wrapped roll (26) can be removed from the rolling-up apparatus (10) by rolling on the pressure belts (96) and on the driven belts (58') of the cantilever belt (58).

21 Claims, 4 Drawing Sheets

APPARATUS FOR WINDING A PRINTED PRODUCT AND A PROTECTIVE WRAPPING INTO A ROLL

FIELD OF THE INVENTION

The present invention relates to an apparatus for rolling up a multipage, folded printed product, particularly a newspaper or periodical, and winding a wrapping around the roll, holding the roll together and protecting the printed product.

BACKGROUND OF THE INVENTION

An apparatus of this kind is known from U.S. Pat. No. 4,748,793. It comprises a forked winding mandrel which is rotatable about its longitudinal axis and into the gap of which a newspaper is introduced and aligned against stops. A delivery device for feeding a wrapping in sheet form is disposed above the winding mandrel. This device comprises a swivelably mounted feed arm which introduces the edge portion of a sheeting web, wound off from a supply reel, from above into the gap between the mutually facing parts of the newspaper, which has already been partly rolled up. The sheeting web is then rolled up together with the newspaper while a desired tension is built up and maintained in the sheeting by means of a pair of dancing rollers. When the newspaper has been completely rolled up, the sheeting web is further wound around the roll and, as the feed arm is swung back, the sheeting web is cut through by means of a heating wire, so that the rolled-up end portion forms a wrapping for the printed product. The regions of the sheeting which overlap adhere automatically to one another and hold the roll together. Finally, in order to separate the wrapped roll from the winding mandrel, pressure rollers pressing the newspaper against the mandrel during the rolling are swiveled away from the roll and the latter is pulled off the winding mandrel in the axial direction. This known apparatus requires manual operation and has a long cycle time.

The object underlying the present invention is therefore that of further developing the apparatus of the type defined, in such a manner that, while having a short cycle time, it can be operated entirely automatically.

SUMMARY OF THE INVENTION

This object is achieved by an apparatus in which the printed product which is to be rolled up is introduced, together with the wrapping, by its leading end region into the gap in a winding mandrel with the aid of a belt conveyor arrangement. Since the wrapping thus lies around the leading end region of the printed product, said wrapping is reliably carried along with the printed product and introduced into the mandrel gap. The wrapping is introduced into the conveying path of the printed product from the side which ensures that during the rolling up it will lie outside the printed product. Short cycle times are thus achieved, because after the printed product has been rolled up only a relatively narrow rear edge portion projecting beyond the end of the printed product has still to be rolled up in order to ensure the connection of this end portion to a region of the wrapping which has previously been rolled up.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE ILLUSTRATED EMBODIMENT

Figure 1:
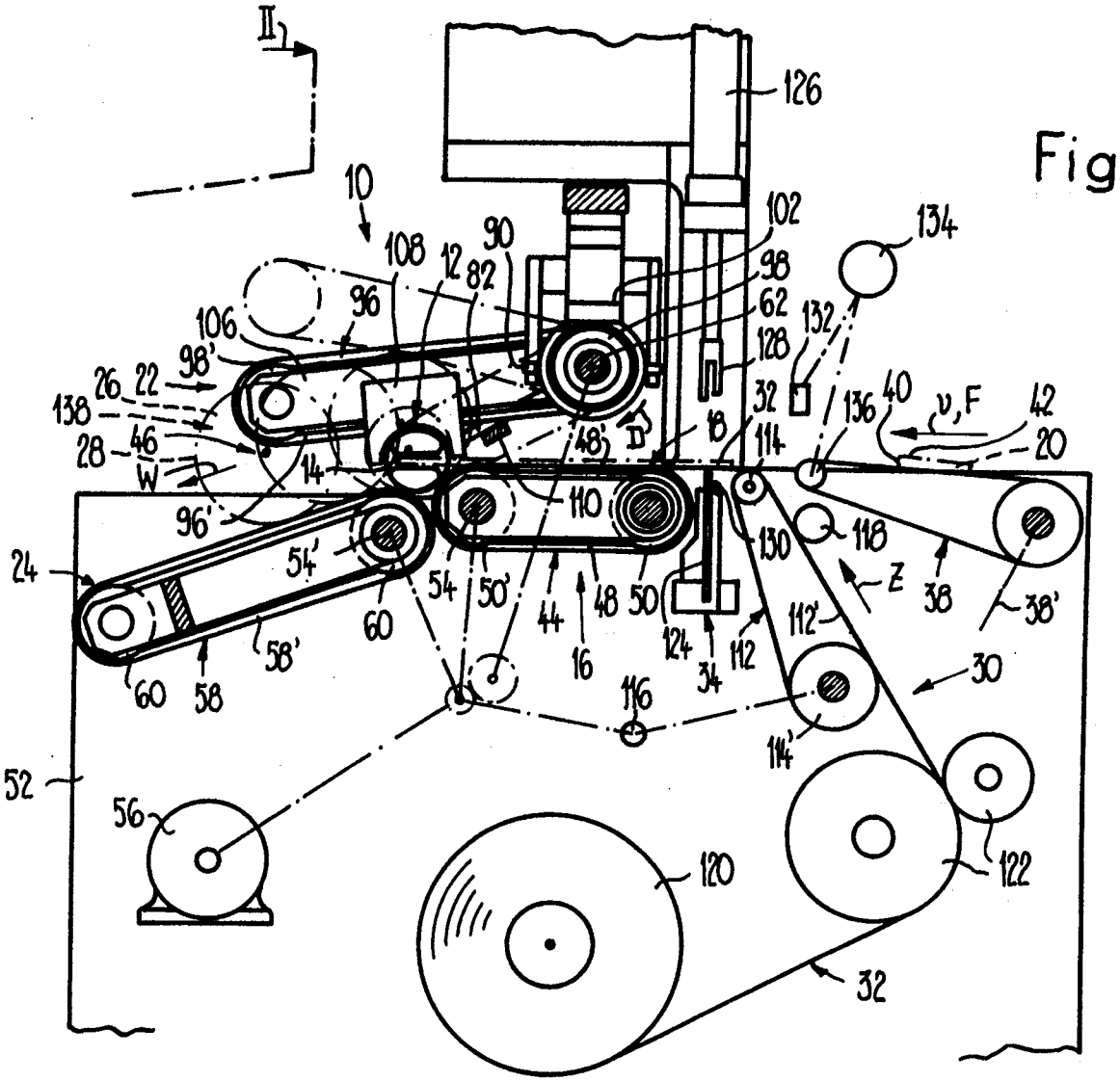
FIG. 1 shows a greatly simplified vertical section of the apparatus according to the invention.
Figure 2:
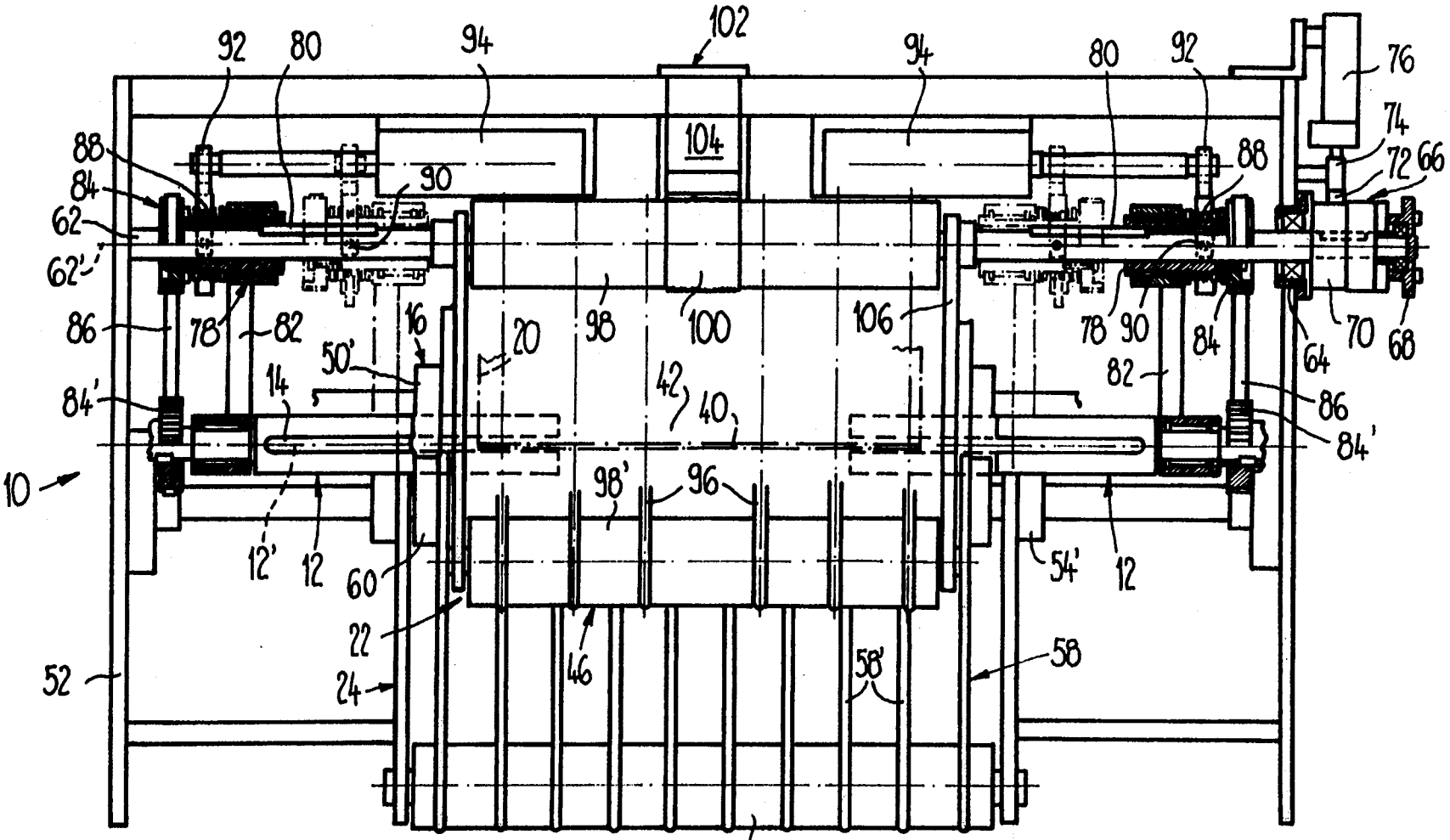
FIG. 2 shows a side view, taken on the line II in FIG. 1, of a part of the apparatus according to the invention, parts thereof being shown in section.

The apparatus shown in FIGS. 1 and 2 comprises a rolling-up apparatus 10 having for example two coaxial, substantially cylindrical winding mandrels 12, which are provided with gaps 14 open towards and in line with one another. Upstream of the winding mandrels 12 is disposed a belt conveyor arrangement 16, which determines a conveying path 18 for a printed product 20, which is to be rolled up, and has a conveying direction which is indicated by the arrow F and extends substantially horizontally and at right angles to the axis 12' of the winding mandrels 12. A swivelably mounted pressure device 22 is disposed above the winding mandrels 12 and downstream of the winding mandrels 12, viewed in the conveying direction F, a cantilever member 24 is disposed for the purpose of carrying away from the rolling-up apparatus 10 the finished printed product 20 rolled up into a roll 26 and having a wrapping 28 wound around it. In the region of the belt conveyor arrangement 16 a delivery device 30 leads from below into the conveying path 18. The wrapping 28 is in each case formed by a portion of a sheeting web 32 separated from the latter by means of a cutting device 34.

The delivery device 30 is designed to hold the leading edge portion 36 (viewed in the feed direction Z) of the wrapping 28 (see FIG. 3) across the conveying path 18, so that the leading edge 40 of a printed product 20 fed in the conveying direction F by means of a feed belt conveyor 38 will run onto the edge portion 36. The edge portion 36 is then laid against the printed product 20, so that it is wrapped around the leading end region 42 of the printed product 20 (FIG. 4), so as to be introduced, together with the latter, into the gap 14 of the winding mandrels 12 (FIG. 5) with the aid of a belt conveyor 44 (FIG. 1). The wrapping 28 separated by means of the cutting device 34 from the sheeting web 32 (FIG. 6) is completely rolled up together with the printed product 20 and, after the winding mandrels 12 have been extracted in the axial direction out of the completely wrapped roll 26, the latter is carried away in the direction of the arrow W in a conveying gap 46 bounded by the pressure device (22) and the cantilever member 24 (FIG. 7). During the rolling up the wrapping 28 lies radially on the outside in relation to the printed product 20.

The constructional design of the apparatus will now be explained in greater detail. The belt conveyor 44 comprises a plurality of endless conveyor belts 48 which are disposed parallel to one another and are guided around common end rollers 50, 50' spaced apart from one another in the conveying direction F. These end rollers 50, 50' are mounted in fixed positions on a frame 52 for free rotation in a generally known manner, and the end roller 50' adjacent to the winding mandrels 12 is connected to a drive motor 56 by way of a freewheel 54, indicated only schematically, acting in the conveying direction F.

Viewed in the conveying direction F, the cantilever member 24 comprising an endless cantilever belt 58 is disposed immediately downstream of the belt conveyor. 44 and the winding mandrels 12. The cantilever belt 58 is guided around end rollers 60, 60' which are likewise mounted in fixed positions on the frame 52, while once again the end roller 60 adjacent to the winding mandrels 12 is connected to the drive motor 56 by way of another freewheel 54', which is indicated only schematically and likewise acts in the conveying direction F. As can be seen in particular in FIG. 2, the cantilever belt 58 consists of a plurality of endless belts 58' disposed parallel to one another.

A drive shaft 62 is mounted, via a freewheel 64 acting in the direction of rotation D, on the frame 52 above the belt conveyor 44, and by means of a generally known single-revolution clutch 66 can be connected to a schematically indicated chain drive 68 connected to the drive motor 56. The part 70, keyed on the drive shaft 62, of the single-revolution clutch 66 is provided with a stop 72 cooperating with a coacting stop 74, which by means of a fast-acting cylinder and piston unit can be brought into and out of the path of the stop 72. When the stop 72 lies against the coacting stop 74, the drive shaft 62 is held fast in an accurately defined rotational position and the freewheel 64 prevents the stop 72 from running off the coacting stop 74 opposite to the direction of rotation D. When the coacting stop 74 is moved away from the stop 72, the single-revolution clutch 66 couples the drive shaft 62 to the chain drive 68.

Two bearing sleeves 78 are mounted on the drive shaft 62, each of them being connected to said shaft by means of a key and groove connection 80 for rotation with the shaft, while being axially slidable thereon. On each of the bearing sleeves a one-armed lever 82 is mounted for free rotation, said levers 82 carrying at their free ends the winding mandrels 12, which in turn are free to rotate. On the end face of each bearing sleeve 78 is fastened a gear 84 which by means of a cogged belt 86 is connected to a gear 84' keyed on the respective winding mandrel 12. The winding mandrels 12 are thus drivingly coupled rigidly to the drive shaft 62.

Between the lever 82 and the gear 84 the bearing sleeves 78 are provided with a groove 88 which extends around them and is open towards the outside and in each of which two slide shoes 90 disposed diametrically opposite one another engage. The slide shoes 90 associated with a bearing sleeve 78 are fastened on an approximately U-shaped control bow 92, which engages from above around the drive shaft 62 and is connected to a cylinder and piston unit 94 acting in the direction of the axis 62' of the drive shaft 60. The two cylinder and piston units 94, which are likewise fastened on the frame 52, act in opposite directions to move the two winding mandrels 12 simultaneously in the direction of the axis 62'. For the sake of completeness it may be mentioned that the axis 12' of the winding mandrels 12 extends parallel to the axis 62'.

The pressure device 22 comprises a plurality of endless pressure belts 96 which are parallel to one another and which are guided around two end rollers 98, 98'. The end roller 98 is mounted on the drive shaft 62 for free rotation. In the middle region between two pressure belts 96 a brake band 100 of a controllable brake device 102 engages around the end roller 98, and is supported in a fixed position at one end and connected at the other end to another, likewise fast-acting cylinder and piston unit 104. In order to stop the pressure belts 96, which are driven by frictional connection with the winding mandrels 12 or the roll 26 only during the winding operation, the brake band 100 can be laid against the end roller 98 by means of the cylinder and piston unit 104.

Lever-like bearing end plates 106 are supported for free rotation on the drive shaft 62 on both sides of the end roller 98, and the end roller 98'is mounted in the free end region for free rotation on said plates. Viewed in the conveying direction F, the winding mandrels 12 are situated approximately in the middle region of the bottom pressure-applying strand 96' of the pressure belts 96.

In the middle region stop members 108 project in the downward direction from the bearing end plates 106 and, when the pressure device 22 has been swiveled into the bottom end position (shown in solid lines in FIG. 1), engage from above, spaced in U-form, around the winding mandrels 12. These stop members 108 serve to prevent the roll 26 from being carried along in the direction of the axis 12' when the winding mandrels 12 are pulled in the axial direction out of the wrapped roll 26.

In its bottom end position the pressure device 22 is supported by means of the bottom strands 96' of the pressure belts 96 against the winding mandrels 12, the bottom end position of which is, for example, defined by stop members 110 cooperating with the levers 82. In this bottom end position the winding mandrels 12 are situated at the end roller 50' and, with the stop 72 lying against the coacting stop 74, are so aligned that the mandrel gaps 14 are in line with the conveying path 18 defined by the upper strands 48' of the conveyor belts 48. It is also conceivable for the winding mandrels 12 in their bottom end position to be supported directly on the bearing arrangment for the conveyor belts 48 in the region of the end roller 50'.

The delivery device 30 comprises an endless delivery belt 112 which is guided around rollers 114, 114'. The operative strand 112' of the delivery belt 112, against which the sheeting web 32 lies, defines with the conveying path 18, which extends approximately horizontally, an angle which is smaller than 90°. The delivery belt 112, which is drivable in the feed direction Z, thus introduces the sheeting web 32 obliquely from below upwards into the conveying path 18, the top roller 114 being tangent to or lying slightly below said conveying path 18. The other roller 114' is connected via a start-stop clutch 116 to the drive motor 56. A pressure roller 118 presses the sheeting web 32 against the delivery belt 112. The sheeting web 32 is drawn off from a storage reel 120 mounted on the frame 52 and extends from said reel through the gap between a pair of rollers 122 to the delivery belt 112.

The cutting device 34 comprises a serrated cutter 124 which is disposed in a fixed position between the roller 114 of the delivery device 30 and the end roller 50 of the belt conveyor 44, under the conveying path 18, and which cooperates with a coacting cutter 128 which can be raised and lowered by means of another fast-acting cylinder and piston unit 126.

Figure 3:
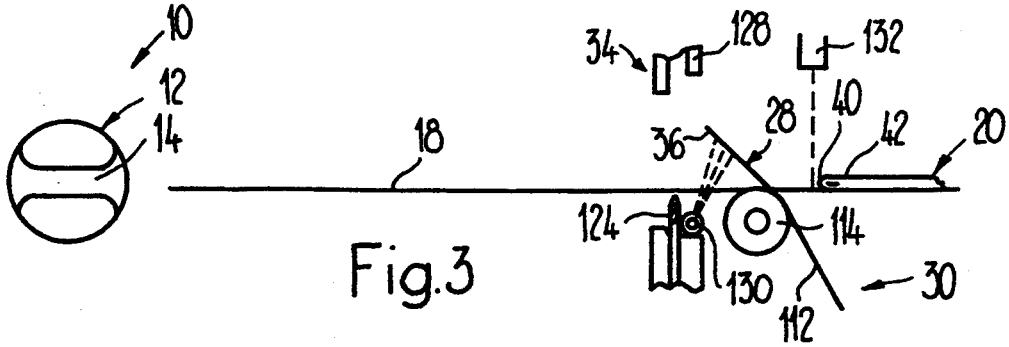
FIGS. 3 to 7 show, in a greatly simplified form, the apparatus of the invention according to FIGS. 1 and 2 at five successive moments in time of a working cycle.
Figure 6:
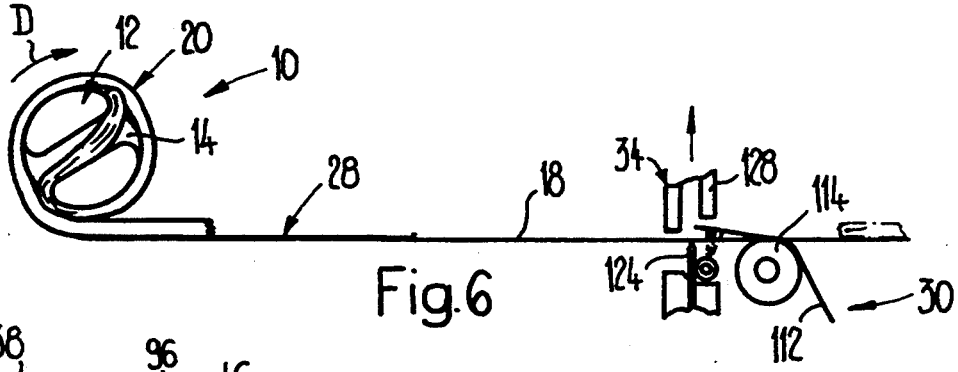
Figure 7:
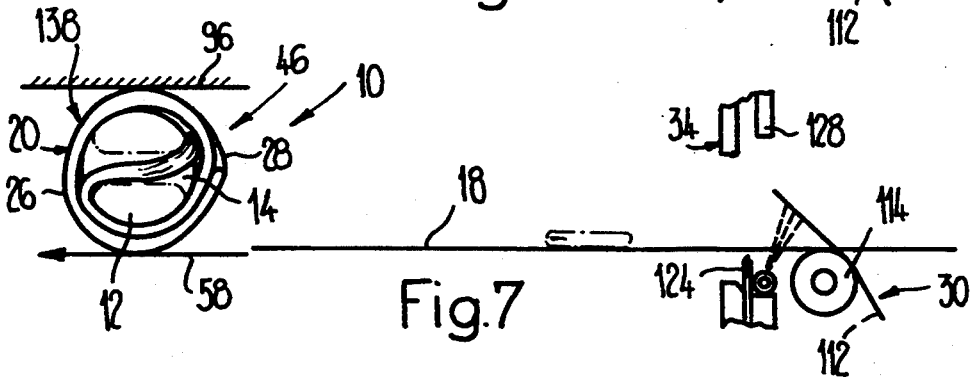

On the serrated cutter 124 a blast nozzle arrangement 130 is disposed, which can be connected to a source of superatmospheric pressure (not shown) and whose blast nozzles are so directed that the air jet blows opposite to the conveying direction F and obliquely upwards, slightly above the roller 114 of the delivery device 30 (see FIGS. 3, 6 and 7). By means of the air jet of this blast nozzle arrangement 130 the edge portion 36 of the wrapping 28 is held across the conveying path 18, projecting therefrom in the upward direction.

As indicated in FIG. 1 by the dot-dash line 38', the feed belt conveyor 38 is also driven by the drive motor 56 in the conveying direction F. That strand of the feed belt conveyor 38 which applies the conveying action is arranged to rise slightly in the conveying direction F, in order to ensure that the printed products 20 being fed to the belt conveyor 44 will not drop into the gap between these two conveyors 38, 44 and the roller 114.

In the end region of the feed belt conveyor 38, and above the latter, a product recognition device 132, for example a light barrier, is disposed which transmits a pulse to a control device 134 whenever a printed product 20 lying on the feed belt conveyor 38 reaches the product recognition device 132. In addition, a tachogenerator 136, indicated only schematically, is coupled to the feed belt conveyor 38 and connected to the control device 134 and supplies to the latter a signal proportional to the conveying speed v. In this connection it may be mentioned that the feed belt conveyor 38, the belt conveyor 44 and the cantilever belt 58 are driven by the drive motor 56 at the same speed v. By means of the control device 134 the fast-acting cylinder and piston unit 76 for the single-revolution clutch 66, the cylinder and piston unit 94 for the axial movement of the winding mandrels 12, the cylinder and piston unit 104 of the brake device 102, the start-stop clutch 116 for driving the delivery device 30, the fast-acting cylinder and piston unit 126 of the cutting device 34, and the blast nozzle arrangement 130 are controlled in the manner described below.

FIGS. 3 to 7 show in each case a winding mandrel 12 and the conveying path 18 along which the printed product 20 which is to be rolled up is introduced into the mandrel gap 14. In addition, the delivery device 30 is indicated, together with the roller 114, over which the wrapping 28 projects by its edge portion 36, which by means of the blast nozzle arrangement 130 is held obliquely upwards across the conveying path 18. In addition, the cutting device 34 is shown in simplified fashion, and in FIG. 7 the bottom strand 96' of the pressure device 22 and the top strand of the cantilever belt 58 are indicated.

Figure 8:
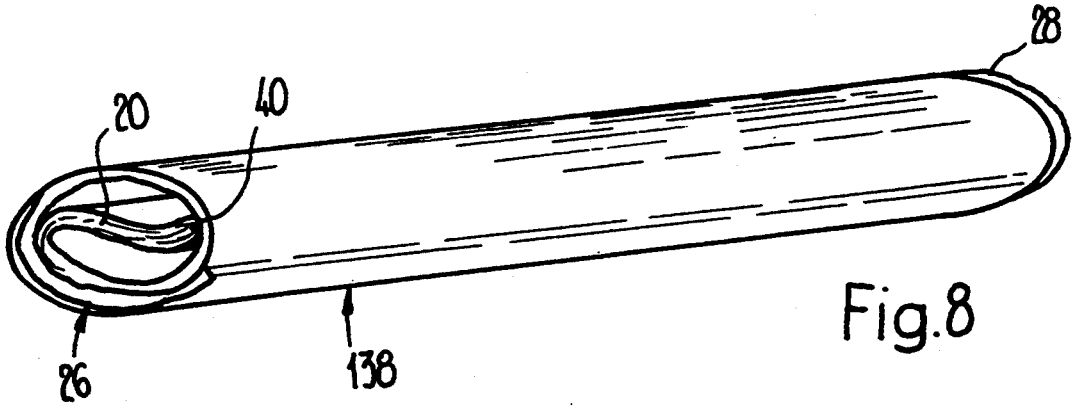
FIG. 8 shows in perspective a finished product produced with the apparatus of the invention according to FIGS. 1 and 2.

FIG. 8 shows a finished product 138 produced with the apparatus shown in FIGS. 1 and 2 and comprising a newspaper rolled up into a roll 26 and a wrapping 28 simultaneously rolled up therewith and consisting of a self-adhesive sheeting material, which completely envelops the roll 26 in the peripheral direction and projects laterally beyond the ends of the roll 26 in the axial direction.

Figure 10:
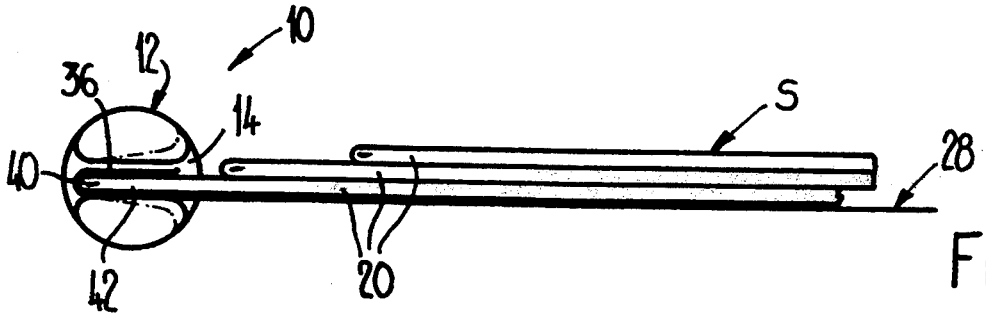
Figure 11:
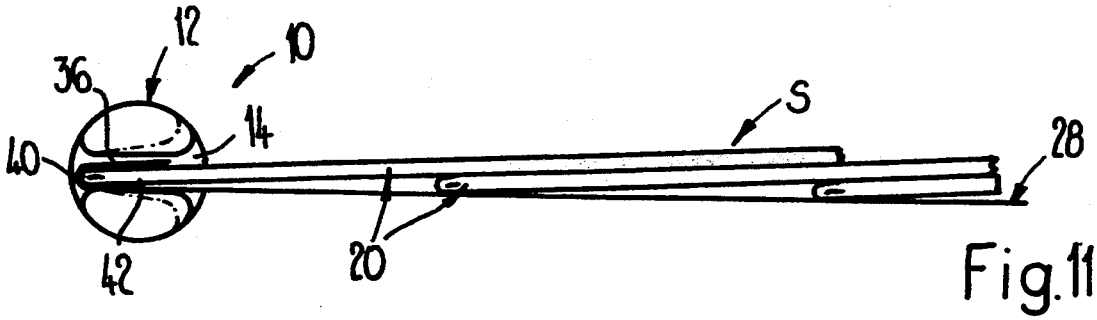

The multipage, folded printed products 20 are introduced into the mandrel gap 14 with their fold at the front. With the apparatuses shown in FIGS. 1 and 2, however, so-called two-fold products can also be rolled up. These two-fold products, such as are in particular known in the newspaper field, are folded along two adjoining edges. In order to produce substantially cylindrical rolls 26 in the rolling up of such two-fold products, it is advantageous for the mandrel gap 14 of that winding mandrel 12 which receives the fold lying at the side, viewed in the conveying direction F, to be widened in the region of the fold and to have a configuration such that it also tapers in the axial direction towards the free end of the mandrel gap 14 and in the direction of the diameter, while in order to introduce in each case a printed product 20 into the mandrel gap 14, the winding mandrel 12 in question is turned to the position in which the widened mandrel gap 14 tapers in the conveying direction F, as shown in FIGS. 9 to 11.

Figure 9:
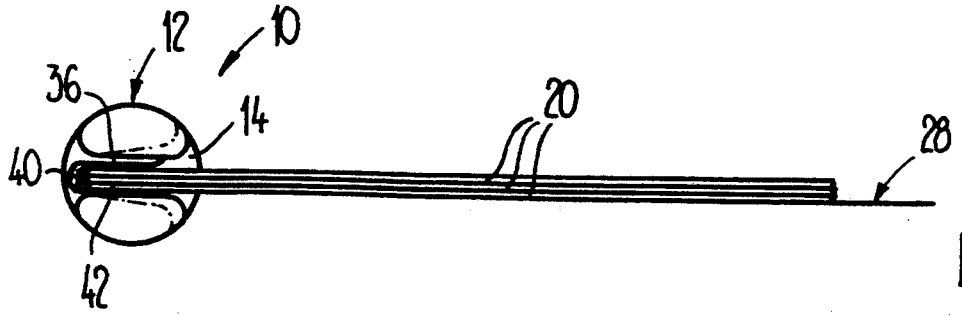
FIGS. 9 to 11 show in a greatly simplified form the apparatus according to the invention during the rolling up of printed products fed in different formations.

With the apparatus described above it is also possible for a plurality of printed products 20 lying one on the other congruently to be rolled up into a roll 26 and to be provided with a wrapping 28 (FIG. 9). As can be seen in FIGS. 10 and 11, printed products 20 fed in an imbricated formation S can also be rolled up into a roll 26 and be enclosed in a wrapping 28. It must then be ensured that in each case only the foremost printed product 20, viewed in the conveying direction, is introduced into the mandrel gap 14. In the imbricated formation S each printed product may in each case rest on the preceding product (FIG. 10) or on the product following it (FIG. 11). It must however be ensured that only a few printed products 20, for example three to five, are rolled up to form a finished product.

The apparatus shown in the figures works as follows: the feed belt conveyor 38, the belt conveyor 44 and the cantilever belt 58 are continuously driven rotationally in the conveying direction F or W respectively at the conveying speed v. The winding mandrels 12 are situated in their bottom end position and are moved by means of the cylinder and piston units 94 into their position shown in dot-dash lines in FIG. 2, in which they are positioned closest to one another. The stop 72 of the single-revolution clutch 66 lies against the coacting stop 74, so that the mandrel gaps 14 are in line with the conveying path 18, as shown in FIGS. 1, 3 to 5 and 9 to 11. The pressure device 22 lies by means of the pressure belts 96 against the winding mandrels 12. The brake device 102 is released. The start-stop clutch 116 is likewise released, so that the delivery belt 112 is stationary. The edge portion 36 of the sheeting web 32 projecting over the roller 114 is held across the conveying path 18 by means of the air jet of the blast nozzle arrangement 130, as shown in particular in FIG. 3.

Figure 4:
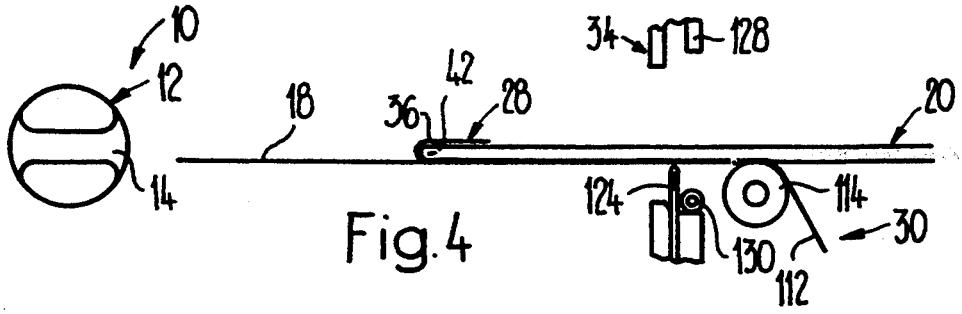

The product recognition device 132 transmits a signal to the control device 134 as soon as a printed product 20 has reached the end region of the feed belt conveyor 38. From that moment on the control device integrates the signal of the tachogenerator 136, whereby the position of the leading edge 40 of the printed product 20 is always known to the control device 134. When the leading edge 40 then reaches the roller 114, the start-stop clutch 116 is closed and the delivery belt 112 is driven in the feed direction Z at a speed corresponding approximately to the conveying speed v. When the leading edge 40 runs onto the wrapping 28, the edge portion 36 of the latter is applied by the action of the air jet and the adhesiveness of the sheeting material against the upper side of the leading end region 42 of the printed product 20 and is wrapped around said region, as can be seen in FIG. 4. The air current is then turned off.

Figure 5:
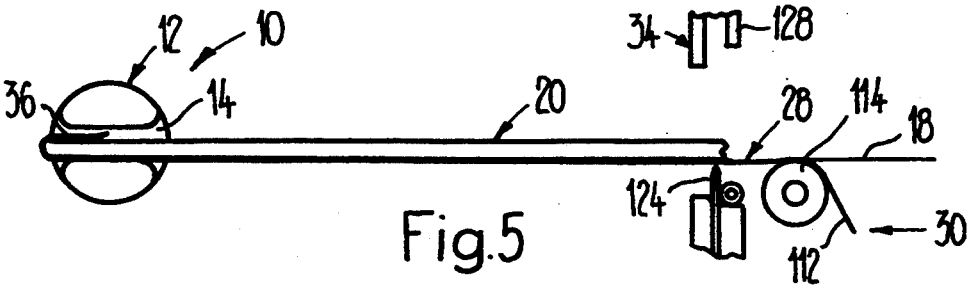

In the course of the further conveying of the printed product 20, the leading end region 42 of the latter, together with the edge portion 36 of the sheeting web 32, is introduced into the gap 14 of the winding mandrels 12 (FIG. 5). The fast-acting cylinder and piston unit 76 then pulls the coacting stop 74 back from the stop 72 as the result of a command from the control device 134, so that the winding mandrels 12 are then driven in the direction of the arrow D at a peripheral speed at least as high as, but preferably higher than, the conveying speed v. A tension is thereby directly built up in the sheeting web 32 between the feed device 30 and the rolling-up apparatus 10, so that in the finished product 138 the wrapping 28 lies tightly around the roll 26. During the rolling up the printed product 20 and the sheeting web 32 are then pressed by the belt conveyor 44 and the pressure belts 96 in the direction of the winding mandrels 12, so that the product is rolled up tightly. Because of the increase in diameter, the winding mandrels 12 are then swiveled in the clockwise direction, swiveling the levers 82, and the pressing device 22 is swiveled, likewise in the clockwise direction, as indicated in dot-dash lines for the pressure device 22 in FIG. 1; the wrapping 28 thus also comes into contact with the cantilever belt 58 and the support is then also provided by the latter. Since the speed of the printed product 20 during the rolling up is higher than the conveying speed v produced by the drive motor 56, the freewheels 54, 54' then come into action and the belt conveyor 44 and the cantilever belt 58 are correspondingly accelerated, which also leads to an increase in the tension of the sheeting.

As soon as the trailing end of the printed product 20 and a portion of the sheeting web 32 following it have passed the cutting device 34, on a command from the control device 134 to the fast-acting cylinder and piston unit 126 the coacting cutter 128 is lowered onto the serrated cutter 124 and raised again, as shown in FIG. 6. At the same time the start-stop clutch 116 is released in order to bring the delivery belt 112 to a stop. The sheeting web 32 is thus cut through along the perforations formed by the serrated cutter 124, so that the portion forming the wrapping 28 can be completely rolled up. The blast nozzle arrangement 130 is then reconnected to the pressure source in order to lift the newly formed edge portion 36 of the sheeting web 132 across the conveying path 18, so that it will be ready for the processing of another printed product (FIG. 6).

As soon as the printed product 20 has been wound into a roll 26 and the rear edge portion of the wrapping 28 has been laid against the portion of the wrapping 28 which has already been rolled up, and said edge portion is held fast there by its adhesive properties, the winding mandrels 12 are simultaneously pulled in the axial direction out of the region of the roll 26 by means of the fast-acting cylinder and piston units 94 and are thereupon brought to rest by means of the coacting stop 74. The cylinder and piston unit 104 of the brake device 102 is then operated by the control device 134 to stop the pressure belts 96. This then has the consequence that the wrapped roll 26, that is to say the finished product 138, is carried away in the conveying gap 46 from the rolling-up apparatus 10, in the direction W, by rolling on the driven belts 58' of the cantilever member 24 and on the stationary pressure belts 96 of the pressure device 22, as indicated in FIG. 1 by the rolls 26 (finished products 138) in dot-dash lines. As soon as the wrapped roll 26 has moved out of the region of the winding mandrels 12 and while the pressure device 22 is still supported by the finished product 138, the winding mandrels 12 are once again moved towards one another in the axial direction by means of the cylinder and piston units 94, so that the pressure device 22 drops once again onto them when the finished product 138 runs off the pressure belts 96 at the end of the pressure device 22. The brake device 102 is then released again, so that the apparatus is then ready to process another printed product 20. Another printed product 20 which is to be rolled up can then be introduced into the mandrel gap 14 during the time when a finished wrapped roll 26 is still being carried away.

It is obviously conceivable to process printed products 20 of different lengths. By means of the product recognition device 132 it is in fact possible for the end of a printed product 20 moving away under it to be recognized, so that the control device 134 also knows at any moment the position of the end of the printed product 20.

It is obviously also possible for individual wrappings of the correct format to be fed by means of the delivery device. It is likewise conceivable for kraft paper or other suitable material to be used as wrapping. An adhesive application device should, if needed, be provided for the adhesive bonding of the wrapping.

It would also be possible to control the positions of the pressure device and the winding mandrels or to provide damping means in order to reduce lowering impact.

In addition it is conceivable for the wrapping to be fed directly at the winding mandrels 12. It is also possible to use only one winding mandrel and, if desired, to eject the wrapped roll from this winding mandrel in the axial direction.

It is also conceivable to use means for forcibly applying the edge portion of the wrapping against the printed product 20. This can for example be done by means of leaf springs projecting into the conveying path 18.

In addition, it is possible without great difficulty to insert an information carrier, in the region of the roller 114, between the sheeting web 32, or the wrapping 28, and the printed product 20 which is to be rolled up, said information carrier being simultaneously rolled up and the information recorded on it being visible through the wrapping 28 in the finished product 138. This information carrier may for example carry address information or brief information concerning the contents of the printed product.

In the drawings and specification, there have been disclosed typical preferred embodiments of the invention and, although specific terms are employed, they are used in a generic and descriptive sense only and not for purposes of limitation, the scope of the invention being set forth in the following claims.

I claim:

1. An apparatus for winding a printed product and a protective wrapping into a roll, and comprising:

means for advancing the printed product along a path of travel so that the advancing printed product has a leading edge and a trailing edge;

means for supplying a wrapping having a dimension in the direction of the path of travel greater than the dimension of the printed product from the leading edge to the trailing edge thereof;

means for advancing the wrapping to a pick-up position from one side of the said path of travel wherein a leading edge portion of the wrapping crosses said path of travel to the other side of said path of travel before contacting the printed product;

means for supporting the wrapping at said pick-up position so that the leading edge portion of the wrapping extends from said one side to said other side of said path of travel and is engaged by and folded about the leading edge of the printed product by the force of the leading edge interacting with the printed product as it is advanced along said path of travel, and so that the wrapping is assembled to and advanced with the printed product as the printed product continues to advance along said path of travel with a trailing edge portion of the wrapping protruding beyond the trailing edge of the printed product; and means for winding the printed product and the assembled wrapping upon themselves, from the leading edge toward the trailing edge of the printed product, so as to produce a roll with the separate wrapping lying outside of and protectively covering the printed product.

2. The apparatus as defined in claim 1 wherein the winding means includes at least one winding mandrel disposed transversely to the path of travel of the printed products and having a longitudinal slot therein for receiving at least a portion of the leading edge of the printed product, and drive means for selectively rotating the at least one winding mandrel.

3. The apparatus as defined in claim 1 wherein the winding means comprises a pair of winding mandrels disposed transversely to the path of travel of the printed products and coaxially with respect to each other, with each of said mandrels having a longitudinal slot therein for receiving a portion of the leading edge of the printed product therein, and drive means for selectively rotating the pair of mandrels in unison and for selectively moving the pair of mandrels axially toward and away from each other so that the mandrels may assume an axially closely spaced apart position during the winding operation and then be axially separated to release the resulting roll.

4. The apparatus as defined in claim 3 wherein said means for advancing the printed product along a path of travel includes an endless belt conveyor which has an upper delivery run which extends to a location immediately adjacent said pair of mandrels and so as to be in alignment with the slots therein.

5. The apparatus as defined in claim 4 further comprising means mounting said mandrels so as to be pivotable away from said upper delivery run of said belt conveyor and so that during the winding operation the resulting roll is supported against the belt conveyor.

6. The apparatus as defined in claim 5 further comprising an endless pressure belt mounted above said pair of mandrels and having a lower run which is supported against the resulting roll as it is wound on said mandrels.

7. The apparatus as defined in claim 6 further comprising a cantilever member disposed downstream of said pair of mandrels and forming with said pressure belt a conveying path for carrying away the resulting roll from said mandrels upon its release therefrom.

8. The apparatus as defined in claim 7 wherein said cantilever member comprises a rotatably driven endless cantilever belt having an upper delivery run which begins immediately downstream of said pair of winding mandrels.

9. The apparatus as defined in claim 8 wherein said pressure belt includes a drive which includes a free wheel clutch and a selectively operable brake, so as to permit rotation to be stopped so that the resulting roll can be readily removed by rolling on the endless belt of said cantilever member.

10. The apparatus as defined in claim 8 wherein said endless belt conveyor includes a downstream end roller, and said cantilever member includes an upstream end roller, with said downstream end roller and said upstream end roller being disposed adjacent and parallel to each other, and with said pair of mandrels being located parallel to and between said rollers.

11. The apparatus as defined in claim 3 wherein the slot in one of said pair of mandrels defines an open end and a closed end, and wherein said closed end of said slot is tapered to define a wedge shape when viewed in transverse cross-section, and so that the slot may readily receive the leading edge of a printed product which is folded along one of its sides.

12. The apparatus as defined in claim 1 wherein said means for advancing a wrapping to a pick-up position includes an endless delivery belt which is guided about an end roller which is adjacent said path of travel, and wherein said means for supporting the wrapping at said pick-up position comprises air jet nozzle means positioned to direct a jet of air to hold the leading edge portion of the wrapping away from the delivery belt and across said path of travel.

13. The apparatus as defined in claim 1 wherein said means for supplying a wrapping includes means for supporting a roll of wrapping material, means for severing the wrapping material at a location downstream of the trailing edge of the printed product.

14. The apparatus as defined in claim 13 wherein said severing means comprises cutting blade means disposed downstream of said wrapping advancing means.

15. The apparatus as defined in claim 14 wherein said air jet nozzle means is positioned between said end roller of said endless delivery belt and said cutting blade means, and so that the air jet acts to lift the leading edge portion of the wrapping which is formed after the cutting operation, across said path of travel.

16. The apparatus as defined in claim 15 wherein said delivery belt is disposed upstream of said endless belt conveyor.

17. The apparatus as defined in claim 3 wherein said drive means for selectively rotating the pair of mandrels acts to selectively hold the mandrels with the slots aligned with said path of travel, and rotate the mandrels at a peripheral speed which is at least equal to the feed speed of belt conveyor for the printed products.

18. A method of winding a printed product and a protective wrapping into a roll, and comprising the steps of:

advancing the printed product along a path of travel, and so that the printed product defines a leading edge and a trailing edge;

advancing a wrapping web to a pick-up position from one side of the said path of travel wherein the leading edge portion of the web crosses said path of travel to the other side of said path of travel before contacting the printed product;

supporting the wrapping web at said pick-up position so that the leading edge portion of the web extends from said one side to said other side of said path of travel and is engaged by and folded about the leading edge of the printed product by the force of the leading edge interacting with the printed product as it is advanced along said path of travel, and so that the wrapping web is assembled to and advanced with the printed product as the printed product continues to advance along said path of travel;

severing the wrapping web at a location downstream from the trailing edge of the printed product and so as to form a separate wrapping which is assembled to the printed product; and then winding the printed product and the assembled wrapping upon themselves, from the leading edge toward the trailing edge of the printed product, and so as to produce a roll with the separate wrapping lying outside of and protectively covering the printed product.

19. The method as defined in claim 18 wherein the printed product is folded and the fold is disposed at the leading edge of the advancing printed product.

20. The method as defined in claim 19 wherein the wrapping web comprises a self-adhering sheet material.

21. The method as defined in claim 18 comprising the further step of physically repeating the recited steps so as to provide for the sequential winding of a plurality of printed products and wrappings into rolls.

* * * * *